US007445162B1

(12) United States Patent
Forsberg et al.

(10) Patent No.: US 7,445,162 B1
(45) Date of Patent: Nov. 4, 2008

(54) GARDEN WATER FEATURE KIT

(75) Inventors: Joel P. Forsberg, Shakopee, MN (US); Benjamin M. Forsberg, Jordan, MN (US)

(73) Assignee: Pre-Fabulous Stone Co., Shakopee, MN (US)

( * ) Notice: Subject to any disclaimer, the term of this patent is extended or adjusted under 35 U.S.C. 154(b) by 0 days.

(21) Appl. No.: 11/893,344

(22) Filed: Aug. 15, 2007

(51) Int. Cl.
*B05B 17/08* (2006.01)

(52) U.S. Cl. ..... 239/17; 239/20; 239/23; 239/16

(58) Field of Classification Search ..... 239/16, 239/17, 20, 22, 23
See application file for complete search history.

(56) References Cited

U.S. PATENT DOCUMENTS 5,637,361 A * 6/1997 Scheurich ..... 428/13
6,149,991 A * 11/2000 Okuda ..... 428/13
6,405,937 B1 * 6/2002 Stukenberg ..... 239/12
6,439,471 B2 * 8/2002 Ehrlich et al. ..... 239/18
6,684,813 B1 * 2/2004 Lemon ..... 119/69.5
2006/0283971 A1 * 12/2006 Hunter ..... 239/16

* cited by examiner

*Primary Examiner*—Dinh Q Nguyen
(74) *Attorney, Agent, or Firm*—Nikolai & Mersereau, P.A.; Thomas J. Nikolai

(57) ABSTRACT

A packaged garden water feature kit comprises a container which, at the time of sale, holds a large decorative stone or rock with a bore formed vertically therethrough, an electric water pump, a length of tubing for connecting the pump outlet to the bore in the stone, a sheet of flexible plastic of a predetermined area having a hole centered therein and a container lid sealing the container with a pattern of perforations formed through it. In use, the container is buried in the ground with the pump within and the tubing projecting out through the lid. The sheet is laid on the ground with the hole centered over the lid and then hidden from a view by landscaping rocks, or mulch. The bore in the decorative stone is then connected to the tubing and the container is filled with water. When the pump is energized, water spills out of the bore and flows over the stone surface for return to the container.

13 Claims, 3 Drawing Sheets

GARDEN WATER FEATURE KIT

BACKGROUND OF THE INVENTION

I. Field of the Invention

This invention relates generally to a decorative water feature for garden and patio use, and more particularly to a water feature kit where all of the necessary components come packaged in a container that itself forms part of the system when installed.

II. Discussion of the Prior Art

Many individuals enjoy the sound and sight of running water, especially in garden areas proximate to decks and patios where persons relax to enjoy the outdoors. This is felt to have a soothing and calming effect.

Many forms of water features are known and in use, including ponds with recirculating water streams flowing over rocks or boulders into the pond. Another form of known water feature includes objects of art such as statuary in which water is pumped from a basin or reservoir at its base to an upper surface of the statuary where it spills out and flows back to the basin. Such units are generally sold in a completed form where all that needs to be done is to fill the basin with water and turn on the electric pump. Such completed systems tend to be relatively expensive, depending upon the complexity of the sculptured work involved and, when molded from concrete, tend to be too heavy for a person to purchase, transport and position at a desired location in a garden or patio setting.

A need, therefore, exists for an easily transportable, low-cost, water feature that can be sold as a kit through home improvement and garden stores and that incorporates all of the essential components allowing a homeowner to inspect the decorative element of the water feature prior to purchase and that comes packaged in an otherwise closed container that itself forms part of the water feature assembly. The present invention provides such an arrangement.

SUMMARY OF THE INVENTION

The foregoing advantages are realized in accordance with the present invention by providing a garden water feature kit that comprises a standard size, five gallon bucket having a closed bottom, an open top and a cylindrical sidewall. Contained within the bucket at the time of sale is a decorative stone that is sized to fit within the bucket with a minimum of clearance space between the stone and sidewalls of the bucket. The stone has a bore formed therethrough from a bottom surface to a top surface. Also packaged within the bucket at the time of sale is a water impervious, foldable, plastic sheet of a predetermined area that is at least five times an area of the bucket's open top. The sheet has a central aperture of an area that is less than that of the bucket's open top. Further included in the kit is a submersible electric pump having an inlet port and an outlet port along with a length of plastic tubing whose outside diameter is sized to fit through the bore in the rock and whose inside diameter is adapted to fit about the pump's outlet port with a friction fit. Completing the assembly is a bucket lid having a pattern of apertures formed through a thickness dimension of the lid, the lid being designed to attach to and cover the bucket's open top with the other mentioned components placed within the bucket.

In use, the bucket is adapted to be buried in the earth beneath the decorative stone to serve as a water reservoir. The pump is adapted to rest in the bucket. The length of tubing is used to join the pump's outlet port to the bore in the decorative stone. Now, when the lid is affixed to the open top of the bucket and the sheet is made to cover a predetermined area about the lid and slopes toward the lid and is laid over the lid with the aperture in the sheet overlaying the pattern of apertures formed in the lid, the sheet can be covered with a desired material to hide it from view. For example, the sheet may be covered with relatively small decorative landscaping rock or a suitable mulch.

When the bucket is filled with water and the pump is turned on, a flow of water is delivered through the bore in the stone to bubble out of the top surface of the stone and flow back down to be collected on the plastic sheet and delivered back to the reservoir through the aperture in the sheet and the pattern of apertures formed in the lid of the bucket.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which.

DESCRIPTION OF THE PREFERRED EMBODIMENT

Figure 1:
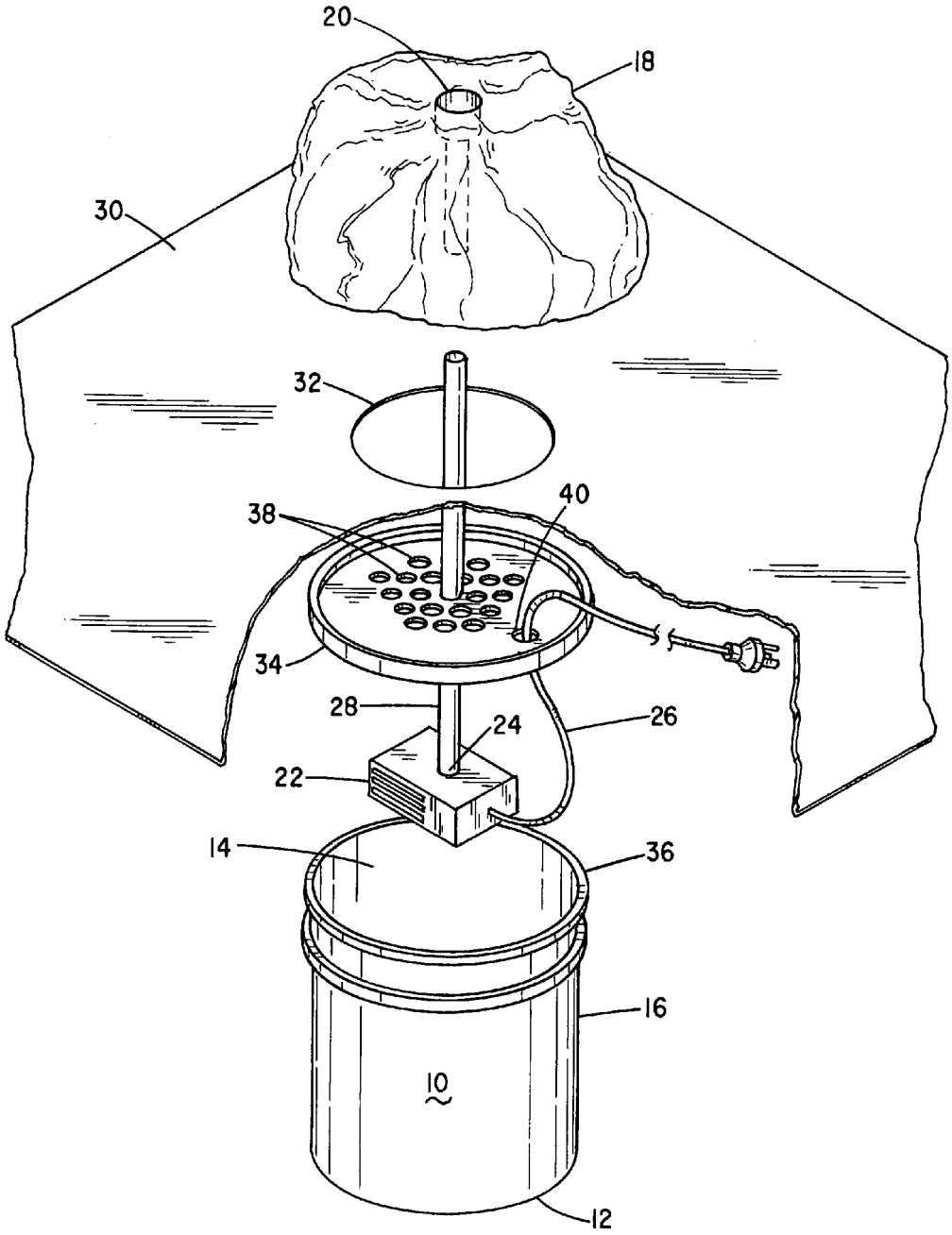
FIG. 1 illustrates the components of the water feature kit when disassembled and removed from the container in which it is packaged at the time of sale.

Referring first to FIG. 1, there is shown a perspective view of all of the components comprising the water feature kit of the present invention. The kit is seen to include a molded plastic bucket 10 having a closed bottom 12, an open top 14 and a sidewall 16 joining the closed bottom to the open top. The bucket 10 is generally cylindrical, but the sidewall 16 may be somewhat tapered inwardly and downwardly is going from the open top 14 to the closed bottom 12.

A decorative stone 18 serves as the art object and is of a size to fit within the bucket 10. The stone 18 is preferably selected to the largest that can conveniently fit within the confines of the bucket 10 or, alternatively, there may be more than a single decorative stone.

Figure 2:
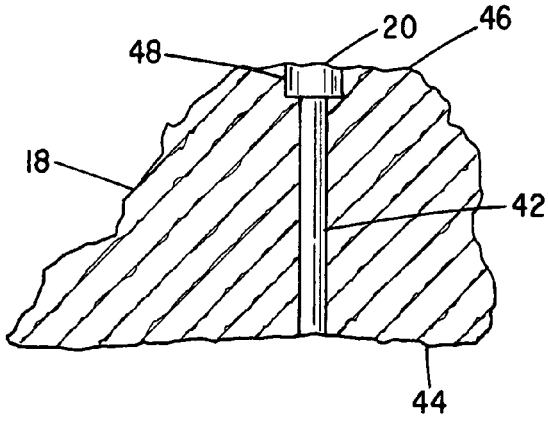
FIG. 2 is a cross-section taken through the decorative stone.

As seen in FIGS. 1 and 2, the stone 18 has a bore 20 extending vertically therethrough from the top thereof to the bottom thereof.

The kit further includes an electric, submersible pump 22 having an inlet port on its undersurface and an outlet port 24 on its top surface. The pump 22 has an electric cord 26 that is adapted to be plugged into a 110 volt AC source having a ground fault interrupter. The pump should be rated at about 100 gallons/hour as a minimum, but with about 130 gallons/hour preferred. With a 130 gallons/hour pump, the water will rise several inches above the stone's upper surface.

With continued reference to FIG. 1, also included in the kit is a length of clear plastic hose or tubing 28 that is adapted to fit onto the outlet port 24 of the submersible pump at a first end as shown and the second end of the tubing 28 is arranged to fit within the bore 20 on the underside of the decorative stone 18.

The kit further includes a water impervious, foldable, plastic sheet 30 of a predetermined area, preferably at least five times the area of the bucket's open top 14. Its area may be in a range of from 4 sq. ft. to 16 sq. ft. with about 9 sq. ft. being preferred. Without limitation, the sheet may be polyethylene, 8 mil. in thickness. Centrally located in the plastic sheet 30 is a central aperture 32 whose area is less than that of the bucket's open top.

It is a preferred aspect of the present invention that the pump 22, the tubing 28, the sheet 30 and the decorative stone 18 all fit within the interior of the bucket 10 while still allowing a lid 34 to be snapped onto the upper rim 36 of the bucket 10. The lid 34 has a pattern of relatively small apertures indicated generally by numeral 38 formed through the thickness dimension of the lid and generally centrally disposed thereon. A further larger aperture 40 also extends through the thickness dimension of the lid. The hole 40 is of a size to permit the plug on the end of the cord 26 to pass therethrough. Surrounding the perimeter of the lid is a vertical flange that extends below the central surface to clamp to the sidewall of the bucket at its open top. The flange also extends somewhat above the central surface to serve as a dirt barrier as will be further explained.

At the time of sale, all of the above-mentioned components are contained within the bucket 10 and with stone preferably resting on a packaging insert (not shown) so that the stone remains elevated within the bucket to the point where a potential customer is able to view its color, texture and contour by viewing same through the apertures 38 and 40 in the lid 34.

Referring next to FIG. 2, there is shown a cross-section taken through the decorative stone 18. Here, it can be seen that the bore 20 has a first segment 42 of a first diameter that extends from the bottom surface 44 of the stone toward, but short of, the top surface 46 and that a second segment 48 of a second diameter, larger than the diameter of the first segment 42, extends from an upper end of the first segment 42 to the upper surface of the stone 46. Without limitation, the diameter of the first bore segment 42 may be ½ inch in diameter and the second segment 48 may be 1½ inch in length and ¾ inch in diameter. It has been found that when water is being pumped through the first segment 42, the head of the water in the second segment 48 has a dampening effect that inhibits the formation of a jet-like stream and causes the water to more gently bubble out from the top of the bore segment 48 only a relatively small distance before falling back on the outer surface of the decorative stone.

Figure 3:
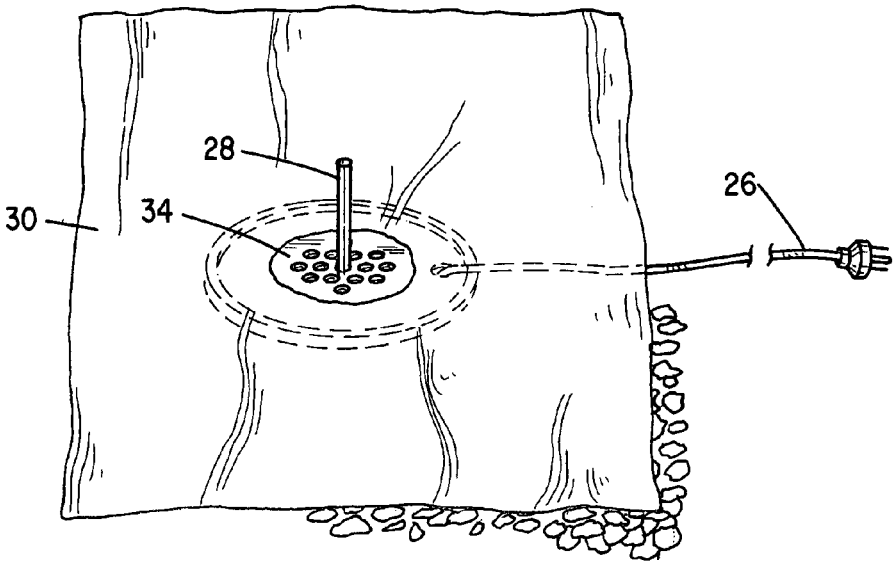
FIG. 3 shows the water feature partially installed in the ground.

Referring next to FIG. 3, there is shown a drawing of the water feature kit partially installed in the ground. In making this installation, the existing decorative landscaping rock, mulch or sod is removed from the area where the water feature is to be installed and a hole is dug to a depth and of a size permitting the bucket 10 to be disposed therein. The ground surrounding the top of the bucket is then sloped inwardly and downwardly toward the bucket. The pump 22 is then placed within the bucket and the tubing connected to the outlet port 24 of the pump is fed up through one of the apertures 38 in the lid 34 while the pump cord 26 is made to exit the pump lid via aperture 40.

Next, the water impervious sheet 30 is spread out over the sloping surface of the dirt surrounding the bucket 10 and with the aperture 32 aligned over the pattern of apertures 38 formed through the lid 34 which, at this time, is secured to the upper rim of the bucket 10. The upwardly extending flange and the lid cooperate with the underside of the sheet to help block dirt from reaching the pattern of apertures 38. Next, the decorative landscaping rock such as river rock or mulch that had been removed prior to digging the hole in which the bucket had been set is replaced onto the surface of sheet 30 to completely hide same from view. This is done in a manner that insures that the sheet is flat with no creases or wrinkles that might block the flow of water returning to the bucket that is serving as the reservoir for the water feature. Once the sheet has been covered with the decorative landscaping rock, mulch or sod, the stone 18 is set in place with the tube 28 projecting up into the bore segment 42 (FIG. 2).

Figure 4:
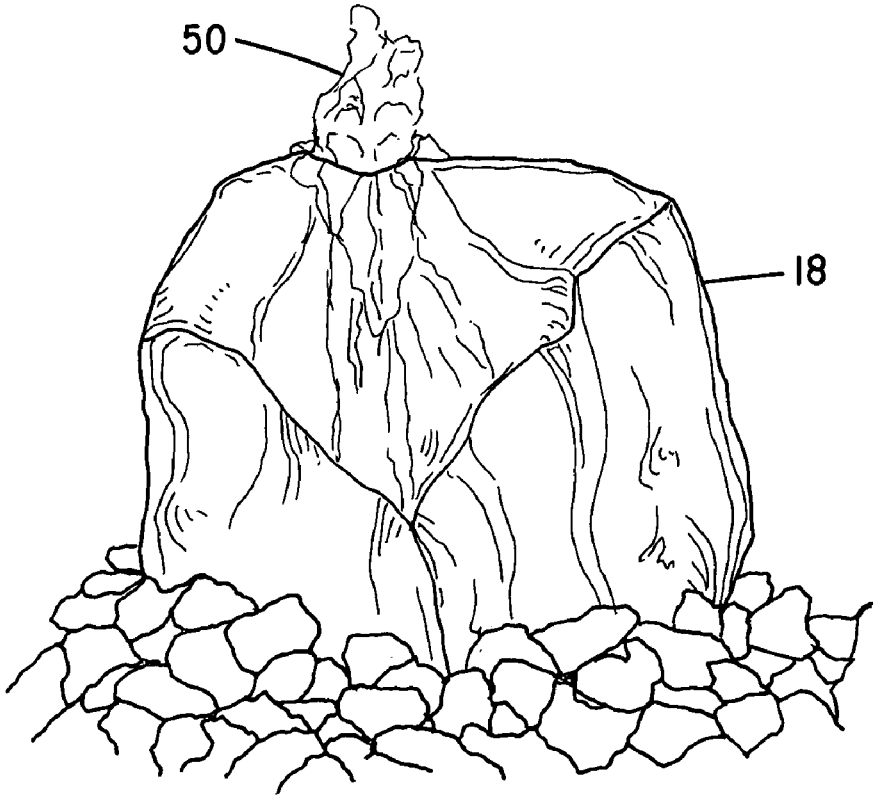
FIG. 4 shows the finished water feature in operation.

Next, the bucket reservoir may be filled with water by directing a stream from a garden hose to the area of the stone 18 water feature whereby the water will flow down the sloping surface of the sheet 30 and through its aperture 32 and the apertures 38 in the lid. Now, when the reservoir is filled and the electrical cord 26 is connected to a 110 volt AC source, a short water spout 50, limited in height by the head of water contained in the segment 48 of the bore, will exit the top of the decorative stone 18, flow down its surface and will return to the bucket reservoir 10 buried there beneath, all as is shown in FIG. 4. As it does so, a relaxing sound of bubbling water that has long held a role in outdoor landscaping will be produced. This combines with the natural beauty of the wet surface of the stone sold with the kit.

In northern climes where freezing temperatures may occur, the water feature of the present invention can be readily winterized by simply removing the tubing from the bore in the rock and turning on the pump to squirt the water from the bucket beyond the border of the sheet 30. The pump is then pulled above the level that might enter the bucket due to snow melt. Ice formation within the reservoir bucket will not result in damage to the pump. Alternatively, a non-toxic antifreeze solution of the type used in water systems of recreational vehicles may also be poured into the buried reservoir and with the system refilled with fresh water the following spring.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A garden water feature to be sold as a kit comprising:

(a) a bucket having a closed bottom, an open top and a cylindrical sidewall therebetween the sidewall having a flange surrounding the open top;

(b) a decorative natural stone sized and shaped to fit within the bucket, the stone having a bore formed therethrough from a bottom surface to a top surface of the stone;

(c) a water impervious, foldable, plastic sheet of a predetermined area at least five times an area of said bucket's open top and a central aperture of an area less than that of the bucket's open top;

(d) a submersible, electric pump having an inlet port and an outlet port;

(e) a length of plastic tubing having an outside diameter sized to fit through the bore in the stone and an inside diameter adapted to fit about said pump's outlet port with a friction fit;

(f) a bucket lid having a pattern of apertures formed through a thickness dimension of the lid, the lid having a size to cover the bucket's open top and a rim configured to receive the flange therein; and (g) the sheet, pump and tubing capable of fitting within the bucket along with the stone, and the bucket lid closing the open top of the bucket at the time of sale, with the bucket adapted to be buried in the ground to constitute a water reservoir.

2. The garden water feature kit of claim 1 wherein the bore formed through the stone has a first segment of a first diameter extending from said bottom surface toward, but short of, the top surface and a second segment of a second diameter, larger than the first diameter, extending from an upper end of the first segment to the upper surface of the stone.

3. The garden water feature kit as in claim 1 wherein, in use, the bucket is adapted to be buried in the earth beneath the stone to serve a water reservoir.

4. The garden water feature kit as in claim 3 wherein the pump is adapted to be disposed in the bucket, and with the tubing joined to the pump's outlet port and to the bore in the stone.

5. The garden water feature kit of claim 4 wherein the lid is affixed to the open top of the bucket and the sheet covers a predetermined area about the lid, slopes toward the lid, and is laid over the lid with the central aperture in the sheet overlaying the pattern of apertures formed in the lid.

6. The garden water feature kit of claim 5 wherein the sheet is adapted to be covered with one of relatively small decorative landscaping rock and, decorative mulch.

7. The garden water feature kit as in claim 1 wherein, in use, the bucket is adapted to be buried in the earth beneath the stone to serve as a water reservoir.

8. The garden water feature kit of claim 1 wherein the bucket is of about a 3.5 to 15 gallon capacity.

9. The garden water feature kit as in claim 1 wherein the sheet is of an area in a range of from about four square feet to about sixteen square feet.

10. The garden water feature kit as in claim 9 wherein the sheet is of an area of about nine square feet and the plastic sheet is polyethylene of about an 8 mil thickness.

11. The garden water feature kit of claim 1 wherein the pump has a capacity of pumping at least 100 gallons per hour.

12. The garden water feature kit of claim 1 wherein the pump has a capacity of pumping about 130 gallons per hour.

13. The garden water feature of claim 1 wherein the outside diameter of the tube is sized to match the diameter of the bore through the rock so as to be insertable therein with a zero clearance fit and the wall thickness of the tube defines a lumen that is less than the diameter of the bore, the tube extending through the bore for a distance less than the full length of the bore.

* * * * *